US007817937B2

(12) United States Patent
Kojima

(10) Patent No.: US 7,817,937 B2
(45) Date of Patent: Oct. 19, 2010

(54) IMAGE FORMING APPARATUS AND ATTACHING METHOD OF CHARGER UNIT IN IMAGE FORMING APPARATUS TO INSTALL/REMOVE MAIN CHARGERS

(75) Inventor: Katsura Kojima, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/431,146

(22) Filed: Apr. 28, 2009

(65) Prior Publication Data

US 2009/0208248 A1 Aug. 20, 2009

Related U.S. Application Data

(62) Division of application No. 11/253,713, filed on Oct. 20, 2005, now Pat. No. 7,546,060.

(51) Int. Cl.
*G03G 21/18* (2006.01)

(52) U.S. Cl. ..... 399/115; 399/93; 399/102; 399/172

(58) Field of Classification Search ..... 399/93, 399/102, 115, 172
See application file for complete search history.

(56) References Cited

U.S. PATENT DOCUMENTS 6,275,670 B1 * 8/2001 Cho et al. ..... 399/93
6,308,024 B1 * 10/2001 Nakayama et al. ..... 399/93
6,339,688 B1 * 1/2002 Cho et al. ..... 399/93
6,975,821 B2 12/2005 Suzuki et al.
7,415,218 B2 * 8/2008 Hori et al. ..... 399/93
2006/0045558 A1 * 3/2006 Nishida et al. ..... 399/93

FOREIGN PATENT DOCUMENTS

JP 2004-045569 (A) 2/2004

OTHER PUBLICATIONS

Katsura Kojima, Office Action, U.S. Appl. No. 11/253,713, Sep. 30, 2008.
Katsura Kojima, Notice of Allowance, U.S. Appl. No. 11/253,713, Feb. 5, 2009.

* cited by examiner

*Primary Examiner*—David M Gray
*Assistant Examiner*—Laura K Roth
(74) *Attorney, Agent, or Firm*—Foley & Lardner LLP

(57) ABSTRACT

In this invention, the charging units are in the separate construction for the main chargers and for the ozone ducts. When installing the process units, the ozone ducts are placed on the elastic sheets of the duct cases that are fixed to the main frame. The process units are slid while slanting the ozone ducts to the duct cases by the main chargers against the bias force of the elastic sheets. Fluctuation in manufacturing accuracy is absorbed by the elastic sheets and the maintenance efficiency when installing/removing the process units is improved by sliding the process units smoothly. Further, the charging units are supported certainly by the main frame.

7 Claims, 5 Drawing Sheets

IMAGE FORMING APPARATUS AND ATTACHING METHOD OF CHARGER UNIT IN IMAGE FORMING APPARATUS TO INSTALL/REMOVE MAIN CHARGERS

The present application is a divisional of U.S. application Ser. No. 11/253,713 filed Oct. 20, 2005, the entire contents is incorporated herein by reference.

FIELD OF THE INVENTION

The present invention relates to an image forming apparatus to form images according to the electro-photographic system such as copying machines, printers and a charging unit fixing method in an image forming apparatus to make it easy to install/remove main chargers.

DESCRIPTION OF THE BACKGROUND

In electro-photographic type image forming apparatus such as copying machines, printers, etc., some of corona type chargers to charge photosensitive drums recover ozone generated by the corona discharge to conserve the environment around an image forming apparatus. In order to recover ozone generated in chargers, there are so far apparatus equipped with ozone recovery ducts on the back surfaces of chargers.

On the other hand, chargers or process cartridges with chargers incorporated are capable of installing or removing to/from the main body of the image forming apparatus by sliding for maintenance, etc. However, when tried to move chargers or process cartridges to the main body of an image forming apparatus by sliding them, ozone recovering ducts of chargers interfere with duct cases at the main body side of the apparatus and the smooth installing/removing of chargers or process cartridges are checked and the maintenance works can be impeded. Further, in a small sized image forming apparatus with downsized component parts arranged in narrow spaces, peripheral components are closely arranged each other and therefore, if chargers or process cartridges are slid by force, they come to contact peripheral components and may generate adverse effects.

So, an image forming apparatus and a method excellent in smooth sliding chargers or process cartridges for installing/removing to/from an image forming apparatus and highly precious installing chargers or process cartridges in the main body of the apparatus tightly to assure the excellent assembling and maintenance efficiency are demanded.

SUMMARY OF THE INVENTION

Therefore, effects of the present invention are to make it possible to smoothly slide chargers or process cartridges, improve the maintenance efficiency, and install chargers or process cartridges in the main body of the apparatus high preciously.

In order to achieve the above-mentioned effects, according to the embodiments of the present invention, it is characterized in that the apparatus is composed of a main frame to support image carriers; charging members that are installed to the main frame by sliding in the axial direction of the driving shafts of the image carriers to charge the image carriers; suction members that are fixed to the main frame at the rear side in the sliding direction of the charging members and have suction ports to suck ozone generated in the charging members; supporting members that are fixed to the main frame to support the charging members; ozone duct members placed on the supporting members in the state with the rear side ends inserted into the suction ports; and elastic members provided between the supporting members and the ozone duct members to bias the ozone duct members in the direction of the charging members installed to the main frame.

DETAILED DESCRIPTION OF THE EMBODIMENTS

Figure 1:
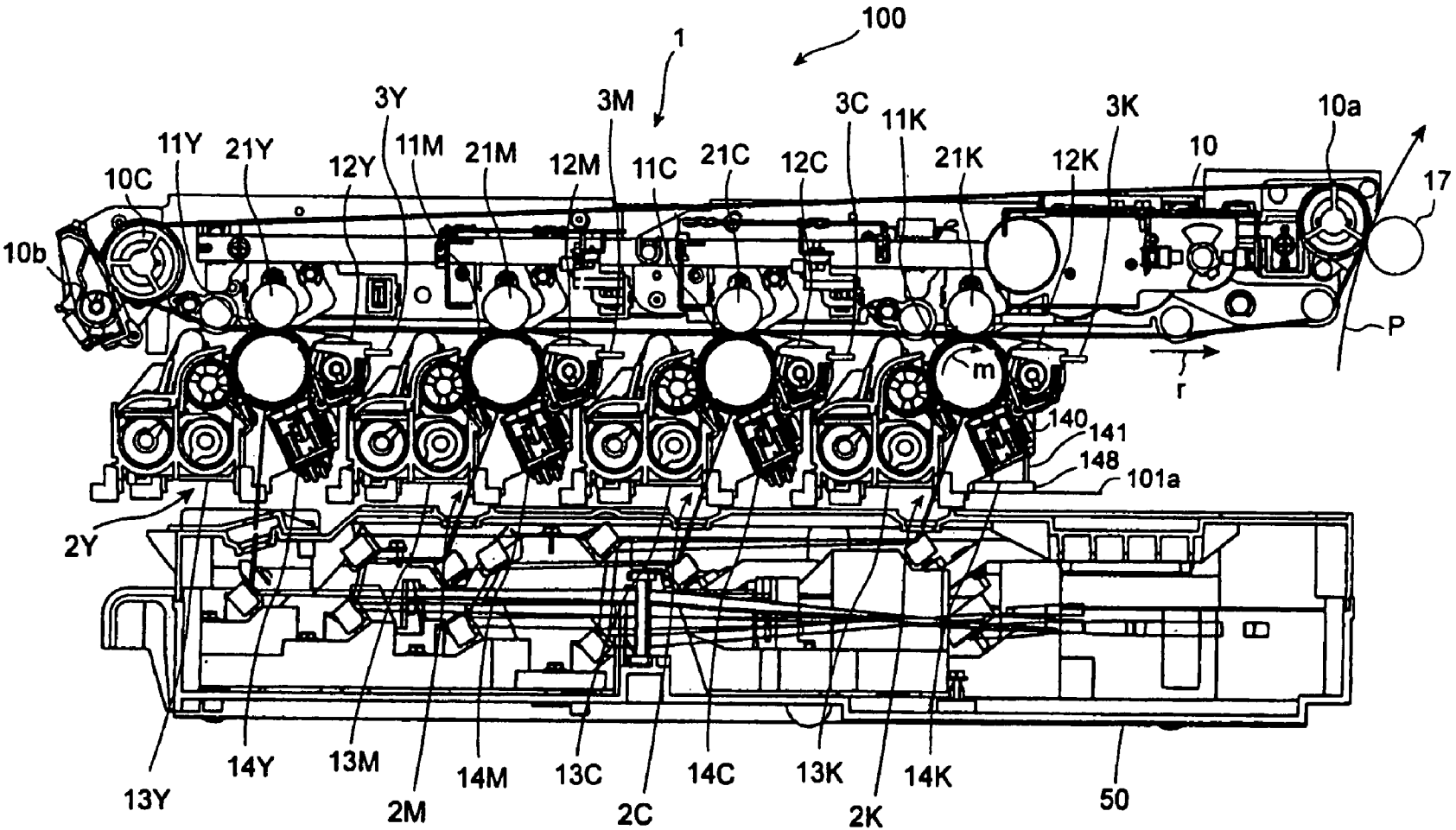
FIG. 1 is a schematic construction diagram showing an image forming unit of a color copying machine in the embodiments of the present invention.

The embodiments of the present invention will be described below in detail referring to the attached drawings. FIG. 1 is a schematic construction diagram showing an image forming unit 1 incorporated in the main body of a quadruple tandem type color copying machine 100 that is an image forming apparatus in the embodiments of the present invention. Image forming unit 1 has 4 sets of process units 2Y, 2M, 2C and 2K of yellow (Y), magenta (M), cyan (C) and black (K) arranged in parallel with along the lower side of a middle transfer belt 10. Process units 2Y, 2M, 2C and 2K have photosensitive drums 11Y, 11M, 11C and 11K, which are image carriers, respectively. Process units 2Y, 2M, 2C and 2K are of cartridge type and are detachable integrally by sliding in parallel with the shafts of photosensitive drums 11Y, 11M, 11C and 11K along guides 3Y, 3M, 3C and 3K from the front side of main frame 101.

At the primary transferring position of a middle transfer belt 10 opposing to photosensitive drums 11Y, 11M, 11C and 11K, primary transferring voltage is applied by primary transferring rollers 21, 21M, 21C and 21K and toner images on photosensitive drums 11Y, 11M, 11C and 11K are primarily transferred on the middle transferring belt.

Middle transfer belt 10 is stretched by a driving roller 10*c* and a secondary transferring roller 10*a*. At the secondary transfer position where a secondary transfer roller 17 is arranged opposing to secondary transferring roller 19*a*, a secondary transfer voltage is applied by secondary transfer roller 17 through a paper P and a toner image on middle transfer belt 10 is secondarily transferred on the paper P. At the downstream of secondary transferring roller 17 of middle transfer belt 10, a belt cleaner 10*b* is provided.

Figure 2:
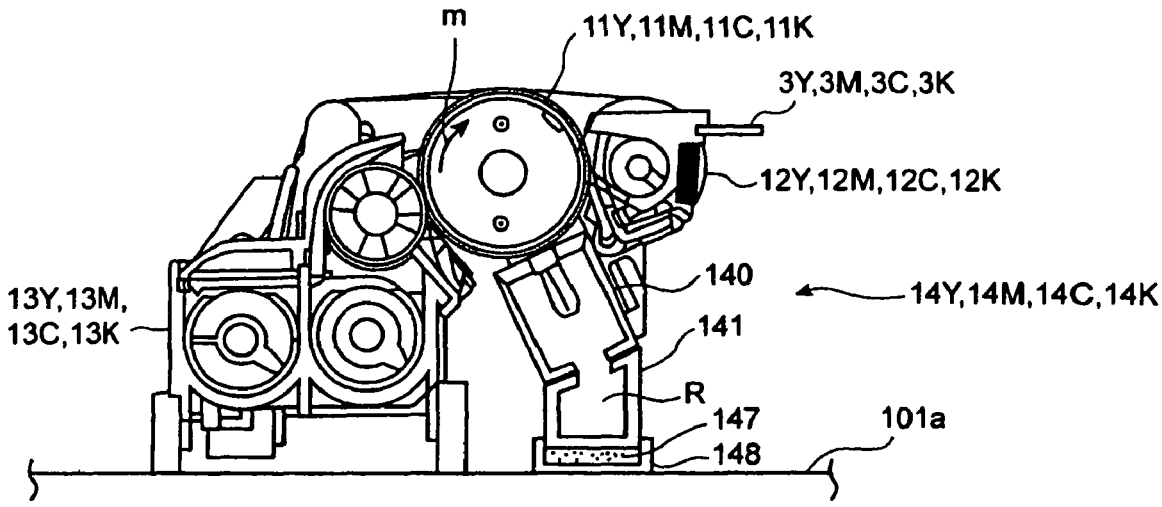
FIG. 2 is a schematic construction diagram showing a process unit in the embodiments of the present invention.

As shown in FIG. 2, process units 2Y, 2M, 2C and 2K have charging units 14Y, 14M, 14C and 14K, developing units 13Y, 13M, 13C and 13K, photosensitive cleaners 12Y, 12M, 12C and 12K arranged in the vicinity of photosensitive drums 11Y, 11M, 11C and 11K along the rotating direction of arrow mark m of the drums. Exposure light is irradiated between the space from charging units 14Y, 14M, 14C and 14K to developing units 13Y, 13M, 13C and 13K around photosensitive drums 11Y, 11M, 11C and 11K by a laser exposure unit 50, which is an exposure member. Further, at around photosensitive drums 11Y, 11M, 11C and 11K, charging units 14Y, 14M, 14C and 14K, developing units 13Y, 13M, 13C and 13K or photosensitive drum cleaners 12Y, 12M, 12C and 12K are detachable as a single body, respectively.

Next, charging units 14Y, 14M, 14C and 14K and their fixing status will be described in detail. Since charging units 14Y, 14M, 14C and 14K are in the same structure, common reference numerals will be used for explanation. As shown in FIG. 2, charging units 14Y, 14M, 14C and 14K are composed of a main charger 140 that is a charging member and an ozone duct 141 that is an ozone duct member, respectively. The frame of main charger 140 is made of stainless steel plate, etc. Ozone duct 141 is made of resin (ABS resin), etc.

Main charger 140 charges photosensitive drums 11, 11M, 11C and 11K through the tip of a needle electrode 142 which has a needle shape boss on a thin metal plate. Main charger 140 and ozone duct 141 are formed in separate structures. When main charger 140 and ozone duct 141 are installed to main frame 101, both of them fit each other and an ozone flow path R is formed on the back of the charging surface by needle electrode 142.

Figure 3:
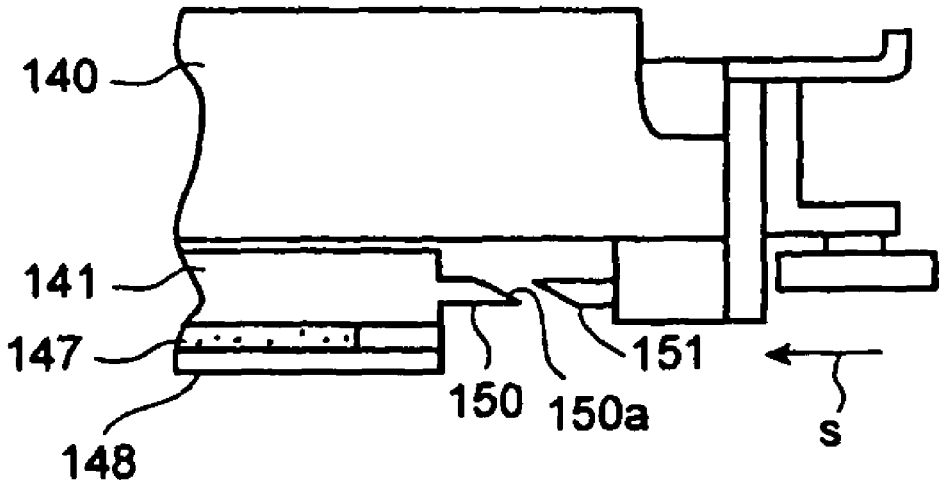
FIG. 3 is a schematic explanatory diagram showing the state of a claw and a locating cam of an ozone duct separately arranged in the embodiments of the present invention.
Figure 4:
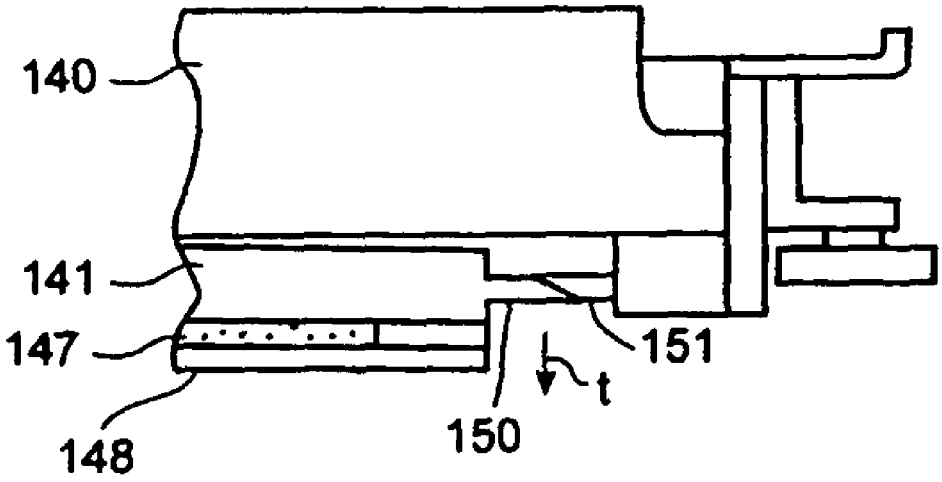
FIG. 4 is a schematic explanatory diagram showing the fit state of the claw and the locating cam of the ozone duct in the embodiments of the present invention.

As shown in FIG. 3 and FIG. 4, a claw portion 150 that is an interference member and has an inclined surface 150*a* on the front side end of ozone duct 141. At the position opposite to claw portion 150 of main charger 140, a locating cam 151 that is a locating member is provided by protruding. Locating cam 151 fits inclined surface 150*a* of claw portion 150 when charging units 14Y, 14M, 14C and 14K are installed in the main body of the apparatus and fixes ozone duct 141 coupled with claw portion 150 on duct case 148 by inclined toward duct case 148.

Figure 5:
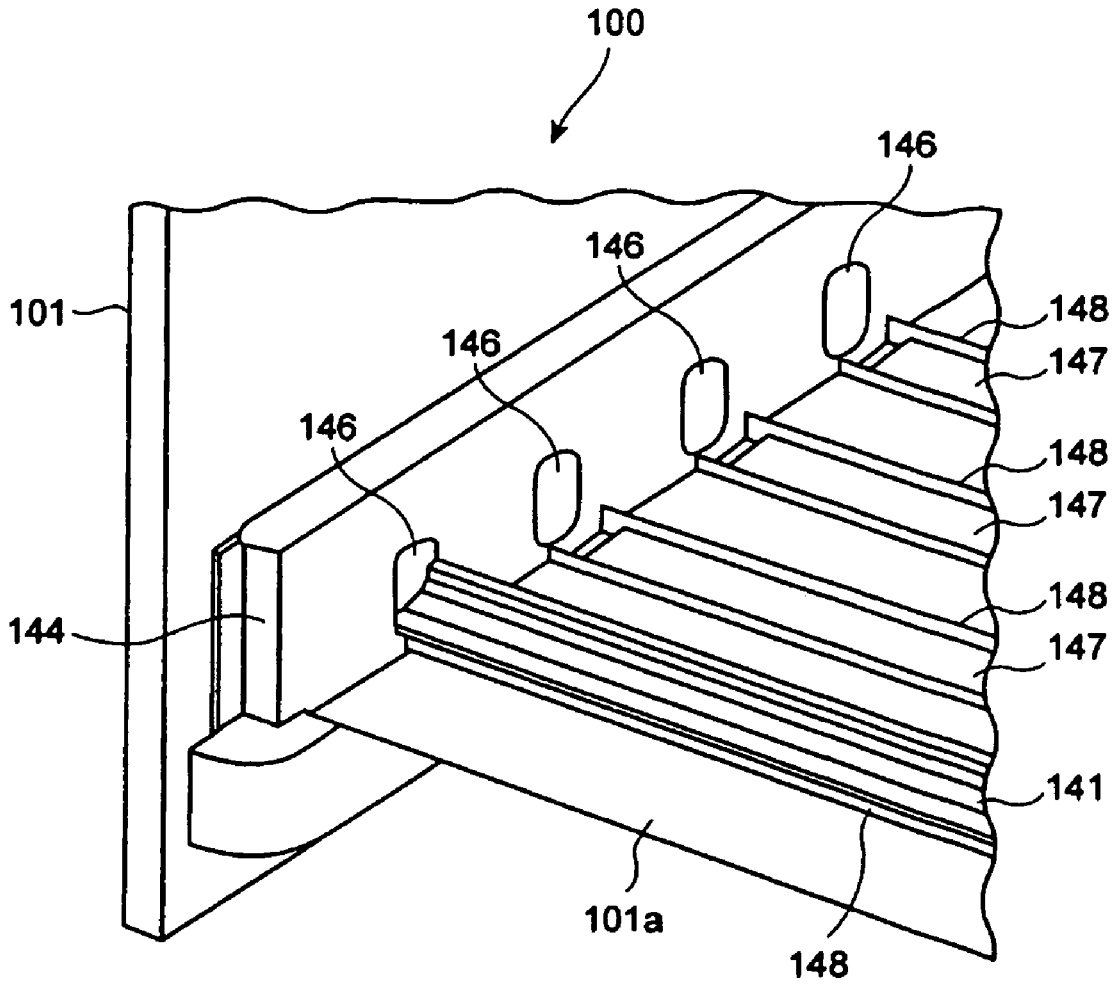
FIG. 5 is a schematic perspective view showing the arrangement of the main frame in the embodiments of the present invention.

As shown in FIG. 5, at the rear side of main frame 101, main duct 144 that is a suction member to suck ozone generated in charging units 14Y, 14M, 14C and 14K and other floating matters are provided. In main duct 144, four suction ports 146 communicating to charging units 14Y, 14M, 14C and 14K are formed. Main duct 144 sucks ozone generated in charging units 14Y, 14M, 14C and 14K by vacuum sucking force and recovers in an ozone recovery unit provided in main duct 144.

Process units 2Y, 2M, 2C and 2K are normally set in main frame 101 based on the driving shafts of photosensitive drums 11Y, 11M, 11C and 11K. Therefore, ozone ducts 141 for charging units 14Y, 14M, 14C and 14K arranged opposing to photosensitive drums 11Y, 11M, 11C and 11K get loose from the supporting members on main frame 101 if there is fluctuation in manufacturing accuracy of process units 2Y, 2M, 2C and 2K. In order to absorb this fluctuation, an elastic sheet 147 made of a sponge that is an elastic member is placed between charging units 14Y, 14M, 14C and 14K and main frame 101.

In main frame 101, duct cases 148 that are supporting members are fixed by welding on a metallic sheet partition plate 101*a* provided between laser exposure unit 50 and process units 2Y, 2M, 2C and 2K. Furthermore, elastic sheet 147 is bonded on duct cases 148. Ozone duct 141 is kept put on elastic sheet 147. Zone duct 141 is biased in the direction of main charger 140 by elastic sheet 147 between main charger 140 and duct case 148 and fixed without looseness in the main body of the apparatus.

Further, the rear side end of ozone duct 141 is inserted into a suction port 146 of main duct 144 and charging units 14Y, 14M, 14C and 14K are thus inserted into main duct 144.

Figure 7:
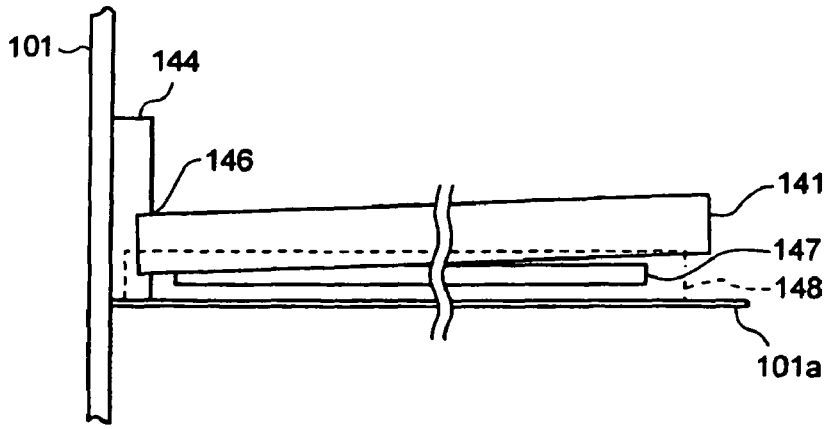
FIG. 7 is a schematic explanatory diagram showing an ozone duct that is put in a duct case in the embodiments of the present invention.
Figure 6:
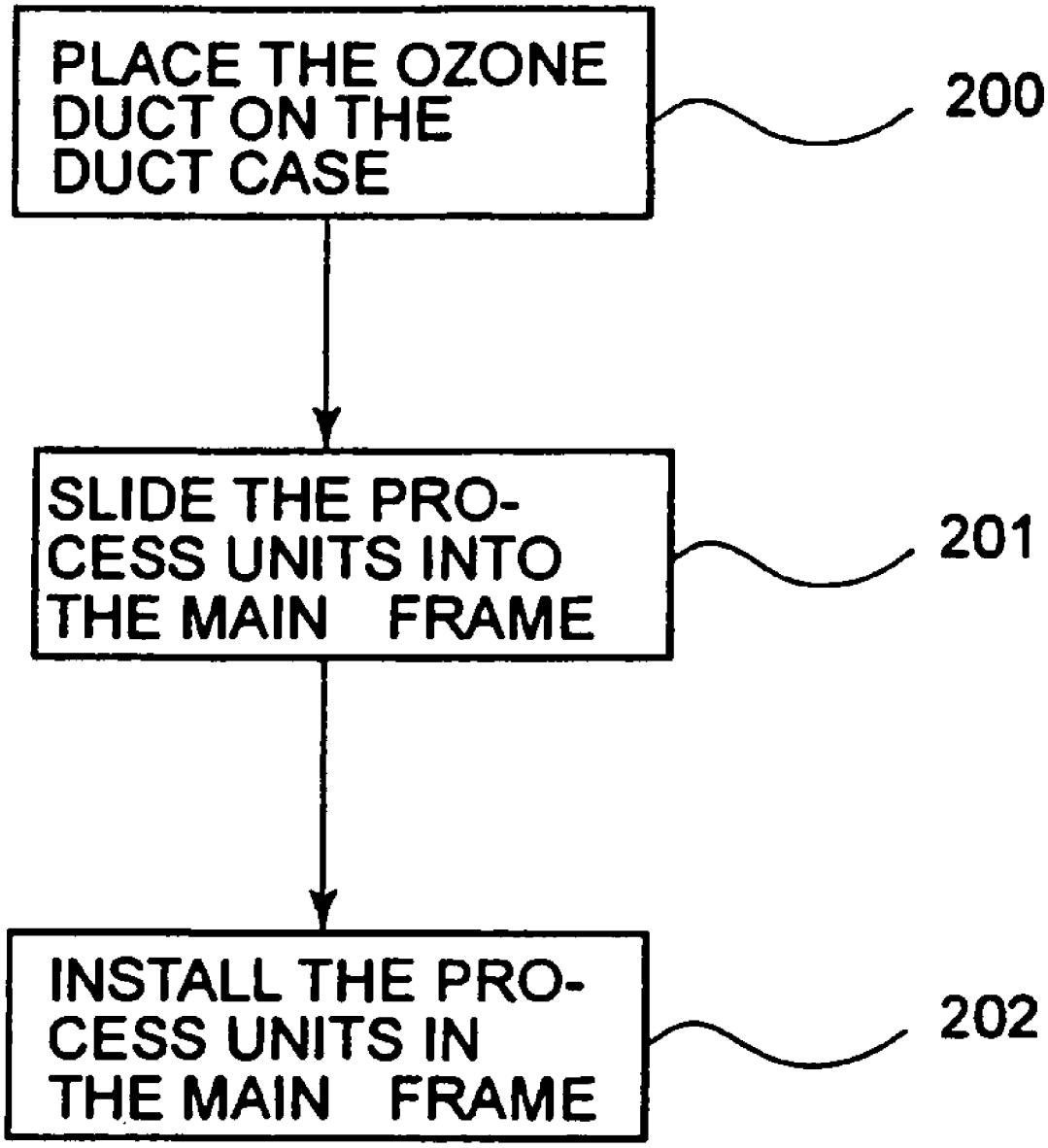
FIG. 6 is a flowchart showing the installation of process unit to the main frame in the embodiments of the present invention.

Next, actions will be described. First, referring to the flowchart shown in FIG. 6, the installation of process units 2Y, 2M, 2C and 2K into main frame 101 will be described. Before installing process units 2Y, 2M, 2C and 2K, ozone duct 141 is placed on duct case 148 in the state with its rear side end inserted into suction port 146 of main duct 144 (Step 200). At this time, the rear side end of ozone duct 141 is defined to suction port 146 of main duct 144. On the other hand, ozone duct 148 is biased upward above duct case 148 by elastic sheet 147 as shown in FIG. 7.

Then, process units 2Y, 2M, 2C and 2K are slid into main frame 101 from the front side along guides 3Y, 3M, 3C and 3K (Step 201). At this time, in charging units 14Y, 14M, 14C and 14K, main charger 140 slides while pushing ozone duct 141 to duct case 148 side against the bias force of elastic sheet 147. At this time, ozone duct 141 is only placed on duct case 148 and elastic sheet 147 exists between ozone duct 141 and duct case 148. Accordingly, even if main charger 140 and ozone duct 148 somewhat interfere with each other for fluctuation in manufacturing accuracy, main charger 140 of process units 2Y, 2M, 2C and 2K can be smoothly slide without receiving a large resistance from ozone duct 141.

Thereafter, photosensitive drums 11Y, 11M, 11C and 11K fit the driving shafts and the installation of process units 2Y, 2, 2C and 2K to main frame 101 is completed (Step 202). At this time, charging units 14Y, 14M, 14C and 14K are slid in the arrow direction and claw 150 of ozone duct 141 contacts locating cam 151 of main charger 140. With the sliding of process units 2Y, 2M, 2C and 2K, locating cam 151 presses down inclined surface 150*a* of claw 150 in the arrow direction t against the bias force of elastic sheet 147.

When the installation of process units 2Y, 2M, 2C and 2K to main frame 101 is completed, ozone duct 141 is slanted in the direction of duct case 148 and fixed at above duct case 148. In this fixed state, ozone duct 141 is always receiving the bias force of elastic sheet 147 in the direction of main charger 140. Accordingly, even if the manufacturing accuracy fluctuates, charging units 14Y, 14M, 14C and 14K are firmly fixed to main frame 101 without becoming loose. Further, charging units 14Y, 14M, 14C and 14K are certainly connected to suction port 146 of main duct 144.

After thus installing process units 2Y, 2M, 2C and 2K to main frame 101, the image forming operation starts and various images are obtained. While the image formation is executed, in the ozone flow path R of charging units 14Y, 14M, 14C and 14K, the air flow toward suction port 146 at the rear side is generated by the vacuum suction force of main duct 144. As a result, the ozone generated by the corona discharge of needle electrode 142 or other floating matters, etc. are sucked in the main duct 144 and recovered in the ozone recovery unit.

When the maintenance works including exchange or cleaning of process units 2Y, 2M, 2C and 2K become necessary while the image forming is being executed, move process units 2Y, 2M, 2C and 2K by sliding to the front side. Charging units 14Y, 14M, 14C and 14K are slid in the direction reverse to the arrow direction s and locating cam 151 of main charger 140 is separated from claw 150 of ozone duct 141.

When process units 2Y, 2M, 2C and 2K are taking out, in charging units 14Y, 14M, 14C and 14K, main charger 140 only is taken out from main frame 101. Ozone duct 141 is placed on duct case 148 in the state inserted into suction port 146 of main duct 144. When process units 2Y, 2M, 2C and 2K are taken out, charging units 14Y, 14M, 14C and 14K can be slid smoothly without receiving a large resistance from ozone duct 141 by elastic sheet 147 that is present between ozone duct 141 and duct case 148. After completing the maintenance, while pressing ozone duct 141 to duct case 148 side against the bias force of charging elastic sheet 147 again, install process units 2Y, 2M, 2C and 2K by sliding into main frame 101 from the front side.

According to this embodiment, charging units 14Y, 14M, 14C and 14K are in separate structures depending on main charger 140 that is slid and moved or ozone duct 141 that is placed on duct case 148 of main frame 101 when process units 2Y, 2M, 2C and 2K are slid. Further, elastic sheet 147 is present between ozone duct 141 and duct case 148. Accordingly, even if main charger 140 interfere somewhat ozone duct 148 for fluctuation in manufacturing accuracy of process units 2Y, 2M, 2C and 2K when sliding process units 2Y, 2M, 2C and 2K, and main charger 140 can be slid smoothly without receiving a large resistance from ozone duct 141, and the inverse influence to peripheral components can be prevented. Thus, process units 2Y, 2, 2C and 2K are moved smoothly during the maintenance operation and the maintenance efficiency can be promoted.

Further, according to this embodiment, locating cam 151 is provided to main charger 140 and claw 150 of ozone duct 141 is slanted and ozone duct 141 is fixed above duct case 148 when completing the installation of process units 2Y, 2M, 2C and 2K. Further, ozone duct 141 is fixed above duct case 148 in the state always biased in the direction of main charger 140 by elastic sheet 147. Accordingly, only when main charger 140 is installed to main frame 101, charging units 14Y, 14M, 14C and 14K can be fixed on duct case 148 without using screws or other fixing members. In addition, even if manufacturing accuracy of components is fluctuated, charging units 14Y, 14M, 14C and 14K can be surely fixed to main frame 101 without causing looseness and furthermore, ozone or other floating matters can be surely recovered and the environmental preservation is obtained.

Further, the present invention is not restricted to the embodiment described above but can be modified variously within the scope of the invention. For example, image carriers, charging units may not be unitized but can be of type constructed in a single unit. Further, the frame of main charger or material of ozone duct is also not restricted. In addition, the elastic member is able to slide to the main charger smoothly and its material and shape, etc. are optional provided that charging units can be fixed without loose to supporting members. Accordingly, the elastic member may not be provided for whole surface between, for example, ozone duct members and supporting members and can be provided on the peripheral edges only or only parts of them.

According to the present invention as described above in detail, as an elastic member is provided between the supporting member and the ozone duct member, it is possible to slide charging members smoothly without causing adverse influences to peripheral units and improve the maintenance efficiency regardless of fluctuation in manufacturing accuracy. Further, only when charging members are installed to the main frame without using exclusive fixing members, charging units can be fixed easily to the main frame. Furthermore, regardless of fluctuation in manufacturing accuracy, the charging units do not generate slackness to the main frame.

What is claimed is:

1. A charging unit fixing method comprising:

providing an elastic member on a supporting member to support a charging member on a main frame;

inserting a rear side end of an ozone duct member into a suction port of a suction member provided on the main frame and placing the ozone duct member on the elastic member; and sliding the charging member in the direction of a driving shaft of an image carrier while pressing the ozone duct member in a direction of the supporting member.

2. The method according to claim 1, further comprising fixing the ozone duct member, by slanting in a direction of the supporting member against a bias force of the elastic member by a locating member provided, to the charging member when the charging member is installed to the main frame.

3. The method according to claim 2, further comprising slanting a front side end, opposite the rear side end, of the ozone duct member in the direction of the supporting member where the front side end is positioned by a locating cam that projects in a direction opposite to the ozone duct member at a front side of the charging member.

4. The method according to claim 1, wherein the elastic member is an elastic sheet.

5. The method according to claim 1, wherein the image carrier and the charging member are incorporated into a single cartridge, this cartridge is installed to the main frame by sliding in a direction of the driving shaft of the image carrier.

6. The method according to claim 1, wherein the ozone duct member is joined with the charging member when the charging member is installed to the main frame by sliding in a direction of the driving shaft of the image carrier, and an ozone flow path is formed on a back of a charging surface of the charging member.

7. The method according to claim 1, wherein the charging member is a main charger, the suction member is a main duct, and the supporting member is a duct case.

* * * * *